United States Patent [19]

Paulsen et al.

[11] 4,294,056

[45] Oct. 13, 1981

[54] VACUUM PACKAGING MACHINE

[76] Inventors: Ralf Paulsen, Kapellenweg 1, Buchenberg; Max Sontheim, An der Steig 17, Wiggensbach; Christoph Ullmann, Falkenweg 17, Kempten, all of Fed. Rep. of Germany

[21] Appl. No.: 80,924

[22] Filed: Oct. 1, 1979

[30] Foreign Application Priority Data

Oct. 4, 1978 [DE] Fed. Rep. of Germany ..... 2843166
Aug. 8, 1979 [DE] Fed. Rep. of Germany ..... 2932098

[51] Int. Cl.[3] ..... B65B 31/02; B65B 43/08; B65B 47/10

[52] U.S. Cl. ..... 53/86; 53/511; 53/559

[58] Field of Search ..... 53/86, 91, 92, 93, 95, 53/96, 89, 510, 511, 432, 433, 559

[56] References Cited

U.S. PATENT DOCUMENTS 3,529,396 9/1970 Young et al. ..... 53/86 X
3,832,828 9/1974 Martin ..... 53/511
3,992,850 11/1976 Vetter ..... 53/510

*Primary Examiner*—Horace M. Culver
*Attorney, Agent, or Firm*—Holman & Stern

[57] ABSTRACT

In a vacuum packaging machine having a forming station and an evacuation and sealing station, wherein each station has a chamber made of an upper and a lower part, and each part comprises a base portion (top cover or floor, as the case may be) and four upstanding walls, one or both of said chamber parts is made from material having an appropriate cross-sectional shape, preferably U-shaped, forming the base portion and opposite side walls, the front and rear walls being secured thereto in the form of covers. The cross-sectional shape may be double U-shaped, providing accommodation for connections for chamber supply requirements (vacuum, air, power). Also the cooling plate for the lower part is secured on the under-side of the floor of said part and mounts it on the means for imparting chamber opening and closing movement to the lower part, while the cooling plate for the upper part is inside the chamber, on the under-side of the top cover.

6 Claims, 4 Drawing Figures

VACUUM PACKAGING MACHINE

BRIEF SUMMARY

This invention is concerned with improvements in or relating to vacuum packaging machines.

In a vacuum packaging machine, as e.g. described in U.S. Pat. No. 3,673,760, depressions for receiving the goods to be packaged are usually formed in the one foil, which serves as the lower foil at a forming station. Thereafter, with the upper foil laid over the depressions with the goods therein, evacuation and sealing together of the foils then takes place. Both the process of forming the depressions in the lower foil on the one hand and also the evacuation and sealing of the packages on the other are effected each in a chamber comprising two parts, viz. an upper and a lower part, said parts being movable relative to one another in order to effect closure and opening of the chambers. The chambers accommodate the requisite devices, e.g. the compartments for forming the desired depressions or the sealing devices, as the case may be. Furthermore, the necessary connections for the supply requirements of the chambers, viz. a vacuum line and a line for air under pressure, an energy supply and a cooling system, are provided in the chambers.

In general the chambers are formed as aluminum castings, the castings each being appropriate to the desired size of the packages. Significant variations in the size can, however, arise. One or several lines of packages can be prepared one beside the other and the length also of the packages differs. According to the length of each package, several rows of packages are simultaneously prepared, that is to say e.g. formed and then evacuated and sealed after insertion of the goods.

The aluminum castings from which the lower and upper chamber parts are formed must be exactly machined, even on those surfaces which do not co-operate with other surfaces. The production of the chambers is thus costly. Also, the problem frequently arises with a machine which is already in operation that, because the packages to be produced undergo alterations with regard to their dimensions, the chambers have to be exchanged after installation. The production of new chambers which are compatible with the new size is then seen to be very time-consuming. Furthermore, because of the multiplicity of sizes, it is not generally viable to provide tooling in order to reduce the production time, and in any event tooling is prohibited because of the cost involved.

The present invention has for its object to provide a vacuum packaging machine having chambers as aforesaid, but in which it is possible to reduce significantly both the cost of production and also the production time without detriment thereby to the quality of the chambers in question.

The invention thus provides a vacuum packaging machine comprising chambers for forming the packaging foil and for evacuating and sealing the packages, each chamber comprising an upper and a lower part, which parts are moveable relative to one another and, in an operative position in which they are pressed together, clamp marginal portions of the foils therebetween, and each chamber part comprising a base portion (constituting a top cover of the upper chamber part and a floor of the lower chamber part) and four walls arranged in a rectangle and upstanding from said base portion, wherein at least one of said chamber parts is made from a length of material having an appropriate cross-section profile, to which the front and rear walls are secured in the form of covers for the ends thereof.

Various possibilities present themselves for the construction of the machine in accordance with the invention. For example, each chamber part may consist of a floor or top cover, as the case may be, and four separate walls, such chamber thus being an assembly of five component parts. Preferably, however, the profile of said material is such that it provides not only the floor or top cover, as the case may be, but also opposite side walls integral therewith, that is to say the floor or top cover, as the case may be, and the two side walls together form a U-shaped extrusion shape. In this way such chamber part consists essentially of only three component parts, viz. the U-shaped center portion and the two walls attached in the manner of covers.

Furthermore, conveniently the extrusion shape of the upper chamber part may have a double U-shape thus providing at the outside of one of the side walls a space for accomodating connections for the supply requirements to the chamber, which space is U-shaped and open underneath. The connections are preferably assembled in a block which can be fitted out away from the chamber or chamber part and then be inserted in the space therefor after completion. Alternatively in another construction avoiding said U-shaped space open underneath, the connections may be assembled in a block which is secured to the outside of one of the side walls.

As is conventional in vacuum packaging machines, the chamber for evacuating and sealing is preferably provided with a cooling system, such system being required because of the heat produced at that station. In the past, various constructions have been available for use. For example high intensity cooling has been achieved in the previously used aluminum casting by inserting a cooling coil therein, thereby affording a cooling effect in the floor or top cover, as the case may be. Alternatively, it has been customary to screw a plate in which a cooling channel has been machined on to the floor or top cover, as the case may be, sufficiently to obtain adequate surface contact therebetween.

The present invention also provides a novel solution to this problem of cooling. Thus in the machine in accordance with the invention the lower chamber part is preferably provided with a cooling plate having channels for the coolant which are closed on all sides, said plate being e.g. arranged beneath the lower chamber part, which part is supported by said cooling plate on the means for moving said lower part heightwise. Generally, therefore, even for chambers of different dimensions the same cooling plate can always be used. In this way, similarly, the production of the machine and tooling therefor are simplified.

If desired, such a cooling plate may also be used with the upper chamber part, said plate being inserted into said chamber part on the underside of the top cover. This arrangement has the added advantage that in special cases, where a cooling effect in the upper part can be dispensed with, it is possible readily to accommodate these requirements.

BRIEF DESCRIPTION OF THE DRAWINGS

Two preferred embodiments of the invention, selected to illustrate the invention by way of non-limiting example, will now be described with reference to the accompanying drawings in which.

DETAILED DESCRIPTION

Figure 1:
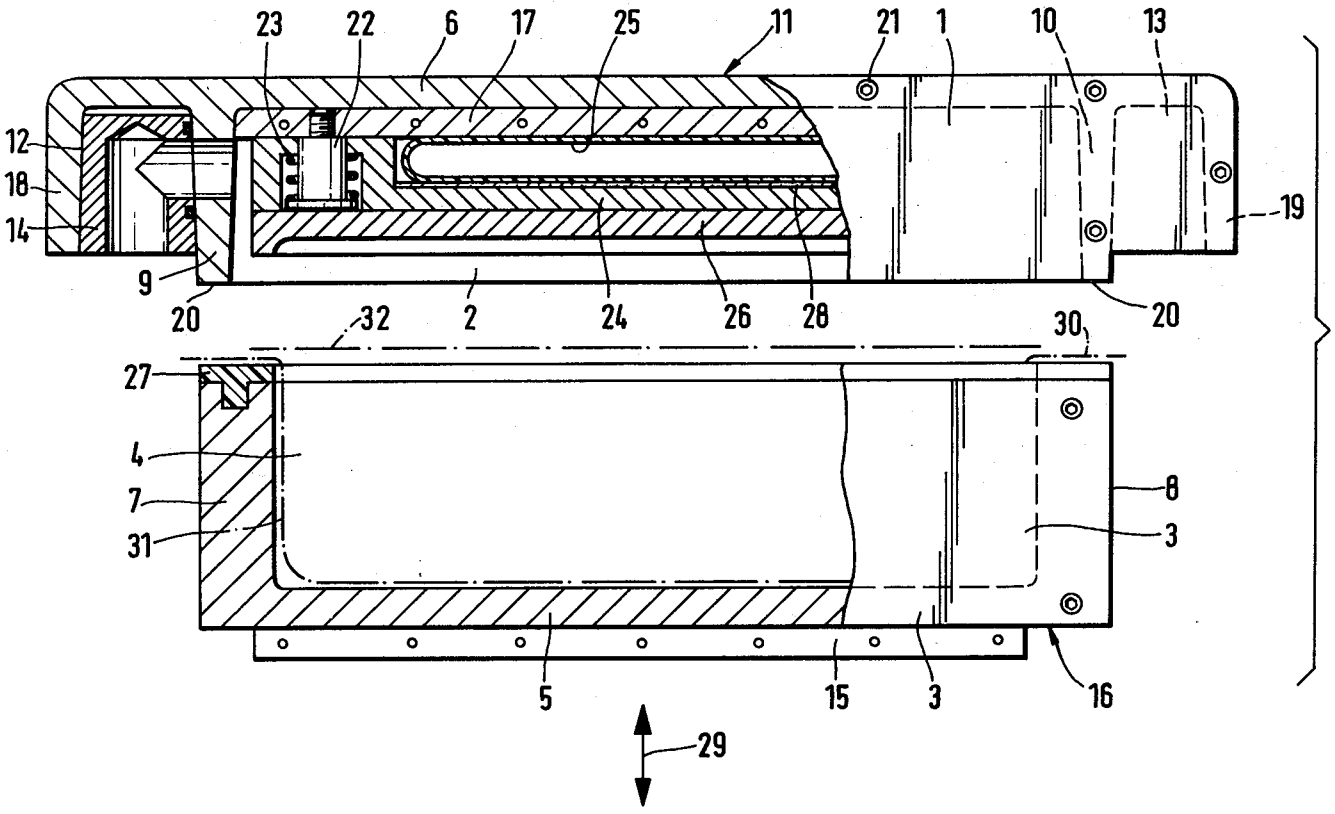
FIG. 1 is an elevational view, partly in section, of the upper and lower parts of the chamber of an evacuation and sealing station of a first illustrative embodiment.
Figure 2:
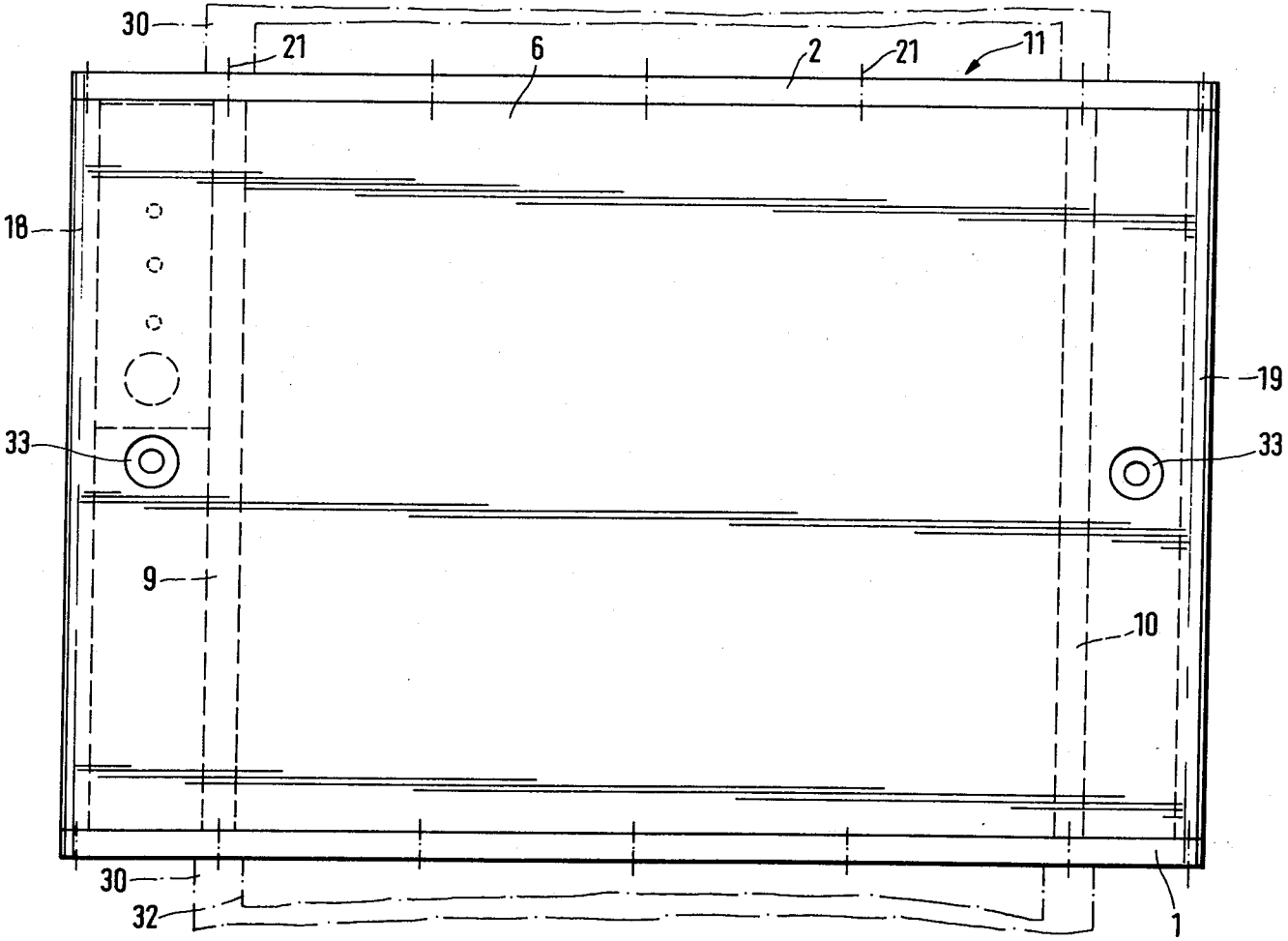
FIG. 2 is a plan view of the parts shown in FIG. 1.

Referring to FIGS. 1 and 2, the first illustrative embodiment has a chamber the upper part generally designated 11 (FIG. 1) of which is formed as a double U-shape. The side walls 9, 10 are formed integral with the top cover 6, and on the outside of said walls are provided the spaces 12, 13, which are U-shaped and open underneath. The spaces 12, 13 are bounded at their outside by the walls 18, 19. These various component parts 6, 9, 10, 18, 19 of the upper part of the chamber thus have a cross-sectional profile and can be provided from material having such a profile.

The invention thus departs from the previous method of production from aluminum castings which are subsequently machined, and turns to production from material having an appropriate cross-sectional profile, which is of course produced in large quantities. This material is generally prepared by an extrusion process and it has been found that by this production method on the one hand manufacturing tolerances can be adequately achieved and on the other hand the surfaces are sufficiently smooth so that subsequent machining on the outer surfaces of the material are by and large unnecessary.

Thus, when a chamber of given dimensions is to be made the corresponding length is cut from the material for the particular chamber part and it is then necessary only to machine the under-side 20 of the walls 9, 10 and the end surfaces, i.e. the cut faces, so that the attached covers which constitute the forward and rearward walls 1, 2, will form an adequate seal therewith.

Since the material having the appropriate cross-sectional profile can be used in practically every case, no problems arise in jigging the material and clearly in this way not only are production costs reduced because the number of surfaces to be machined is low, but especially the production time is greatly reduced also.

Furthermore, since it is possible for the outer dimensions of the chamber for the forming station and of that for the evacuation and sealing station to be compatible with each other, the invention requires only material of said profile for the upper part or the lower part, as the case may be.

As already mentioned, the front and rear sides of the component parts 6, 9, 10, 18, 19 are covered by the walls 1, 2 in the form of covers. These are secured by means of screws 21, with suitable sealing means interposed.

Of the spaces 12, 13 which are open underneath in the form of an inverted U, the space 12 receives the block 14. In the block 14 the necessary connections are accommodated, namely for the cold water inlet and outlet, the supply of air under pressure and the vacuum. Corresponding bores in the wall 9, leading to the inside of the chamber, then connect to the block 14.

Inside the chamber the cooling plate 17 is secured to the under-side of the top cover 6 and the guide bolts 22 serve to locate the pressure plate 24, which is moveable under the action of the pressure cushion 25, which can be pressurised by air under pressure. The springs 23 return the pressure plate upwardly when the pressure cushion is evacuated. The pressure plate 24 carries the surface heater or sealing frame 26 which co-operates with the sealing rubber seal 27 on the lower part generally designated 16 of the chamber. An insulating layer 28 is also provided between the pressure cushion 25 and the pressure plate 24.

The lower part 16 of the chamber comprises the floor 5 and the walls 7, 8 unitarily connected therewith. At the forward and rearward ends are provided the walls 3,4 which, similarly as with the upper part, are secured by screws 21 to the U-shape.

Beneath the floor 5 is provided the cooling plate 15, by means of which the lower part of the chamber is supported on the means (not shown) for moving said lower part heightwise.

As is known per se in a cycle of operation of the machine the lower part 16 of the chamber is moved up and down in the direction of the arrow 29, so that the lower foil 30 with the cup-like depressions 31 can be introduced into the chamber. After evacuation, the upper foil 32 is welded to the lower foil and the chamber is then opened. The drive means for moving the upper part of the chamber engage on the fixings 33.

Figure 3:
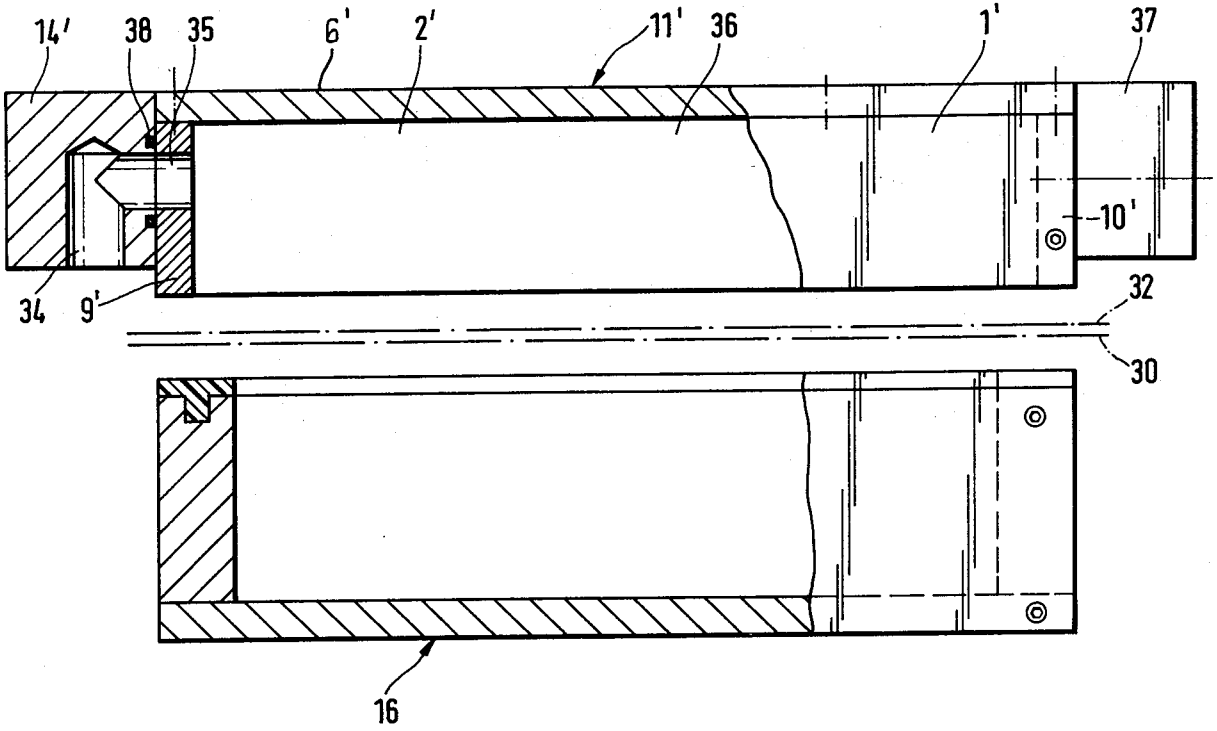
FIGS. 3 and 4 are respectively an elevational view, partly in section, and a plan view, similar to FIGS. 1 and 2, of said chamber parts of a second illustrative embodiment.
Figure 4:
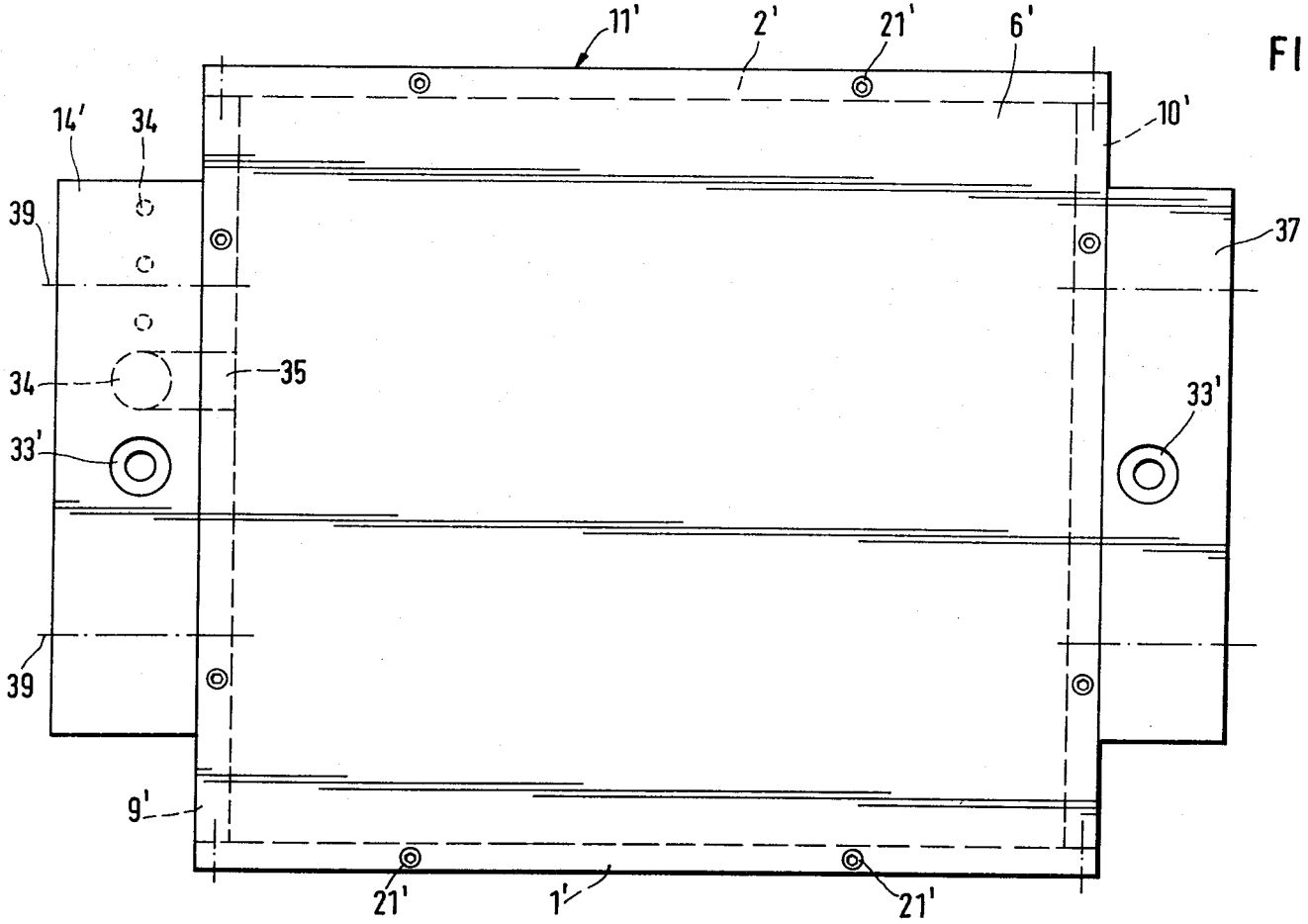

Referring now to FIGS. 3 and 4, the components built into the space 36 of the second illustrative embodiment are not shown in detail, since they are conventional and known per se. The upper part 11′ of the chamber in this embodiment is constructed from a top cover 6′, which has a plate-like shape and on which the walls 1′, 2′, 9′, 10′ are mounted. The connection between the top cover and walls is thus made by screws 21′. On the outside of the side wall 9′ is screwed the block 14′ into which the connections 34 are inserted for the various actuating means of the chamber. Bores 35 are provided in the wall 9′ and enable the inside chamber 36 to be connected up. O-rings 38 set into the block 14′ provide a seal for the interconnection of the connections 34 with the bores 35. The block 14′ is secured by screws schematically shown at 39.

A further block 37 is secured on the other wall 10′ in the same manner as the block 14′ on the wall 9′. This block 37 has only the fixing means 33′, which are also provided on the block 14′. The fixing means serve to connect the chamber with the other parts of the machine.

The foils between the two chamber parts 11′, 16′ are designated 30′ and 32′.

We claim:

1. A vacuum packaging machine comprising chambers for forming a packaging foil from at least two foils and means for evacuating and sealing the packages, each chamber comprising an upper and a lower part, which parts are movable relative to one another and, in an operative position in which they are pressed together, clamp marginal portions of the foils therebetween, each chamber part having a hollow recess in its central region formed by a plate portion and four walls arranged in a rectangle, said walls depending from said plate portion of said upper part and upstanding from said plate portion of said lower part to form a single chamber when pressed together, wherein at least one of said chamber parts is made from a preformed length of material having an appropriate cross-sectional profile to provide two opposite walls integral with said plate, and the other two walls are formed by covers attached to said integral walls and plate.

2. A machine according to claim 1 wherein said cross-sectional profile is a U-shaped profile.

3. A machine according to claim 2 wherein said chamber part made from a preformed length of material has a double U-shape formed by an additional integral wall to provide at the outside of one of said integral side walls thereof a service space for accommodating connections for said evacuating and sealing means to the chamber, said connections being integrally formed in a separate block member which is inserted into said service space.

4. A machine according to claim 1 wherein the lower chamber part is provided with a cooling plate having channels for the coolant which are closed on all sides, said cooling plate engaging the outside of said plate portion of said lower chamber part, means to move said lower part up and down, and said lower part being supported by said plate portion on said means for moving the lower chamber part.

5. A machine according to claim 4 wherein said upper chamber part has inserted therein, on the inside of said plate portion thereof, a cooling plate having channels for a coolant which are closed on all sides.

6. A machine according to claim 1 wherein on the outside of the wall opposite the wall to the outside of which said block is secured there is secured a further block, the two blocks being provided with fixing means by which said chamber part can be connected to other parts of the machine adapted to move said chamber part up and down.

* * * * *